US005217141A

United States Patent [19]

Ross

[11] Patent Number: 5,217,141

[45] Date of Patent: Jun. 8, 1993

[54] UNIQUE DRINKING MUG AND LID

[76] Inventor: Gary Ross, 140 Oxnard Ave., Oxnard, Calif. 93035

[21] Appl. No.: 875,020

[22] Filed: Apr. 28, 1992

[51] Int. Cl.[5] ..... B65D 39/00

[52] U.S. Cl. ..... 220/713; 220/307

[58] Field of Search ..... 220/306, 307, 703, 711, 220/713, 714, 715; 222/544, 547, 554, 555, 563

[56] References Cited

U.S. PATENT DOCUMENTS

| | | | |
|---|---|---|---|
| 2,143,027 | 1/1939 | Perry | 220/703 X |
| 2,601,767 | 7/1952 | Wall | 220/713 X |
| 4,582,218 | 4/1986 | Ross | 220/290 |
| 5,018,636 | 5/1991 | Ross | 220/307 X |
| 5,102,000 | 4/1992 | Feltman, III | 220/297 |

*Primary Examiner*—Allan N. Shoap
*Assistant Examiner*—Nova Stucker
*Attorney, Agent, or Firm*—Thomas I. Rozsa; Dong Chen

[57] ABSTRACT

The present invention relates to the field of liquid beverage containers which prevents the liquid from spilling or splashing, inhibits heat transfer, and keeps the container upright. The beverage container is designed to include a ring section having an inner concave surface to securely hold a flexible lid part. The flexible lid part which removably fits to the inner concave ring surface at the ring section of the mug includes a notch aperture on its circumference for allowing a small amount of fluid to flow through for drinking while the lid is in place and a finger pull for handling the lid part.

19 Claims, 3 Drawing Sheets

FIG. 1
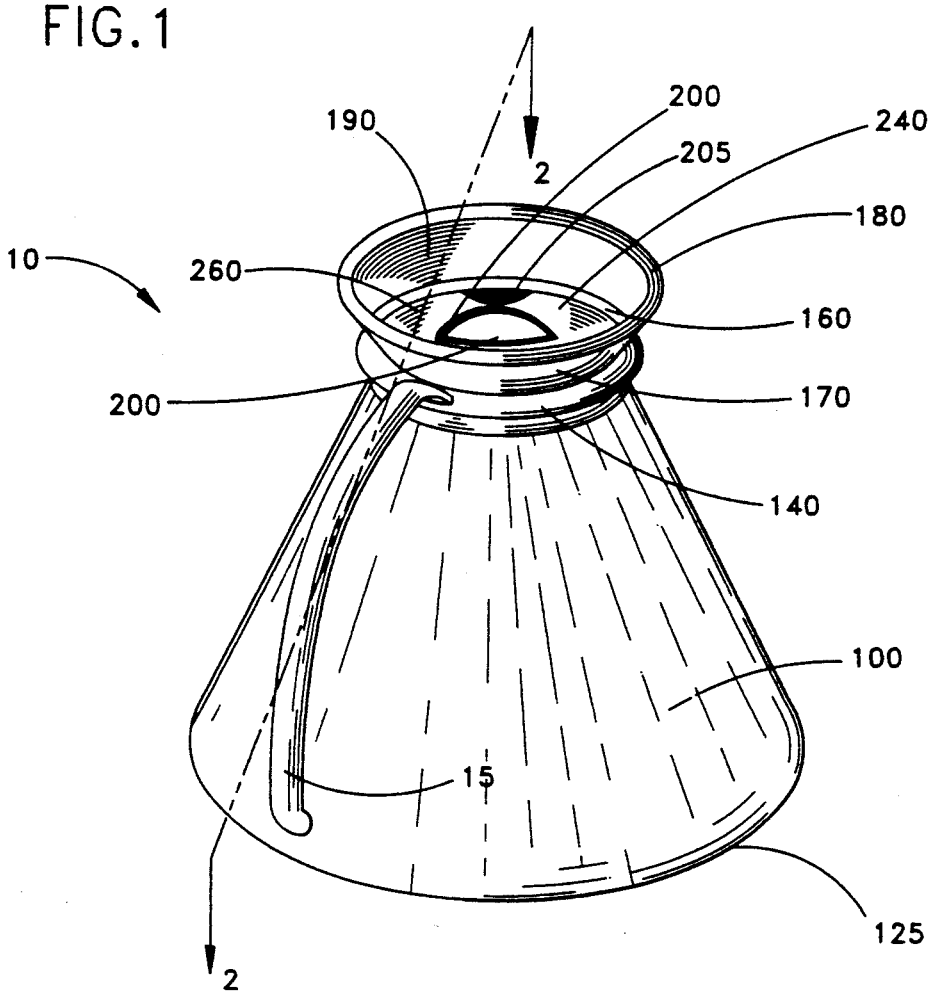
FIG. 2
(Section on line 2 - 2)
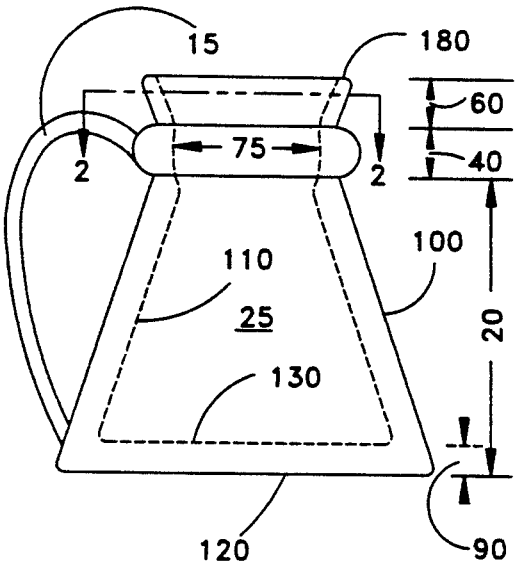
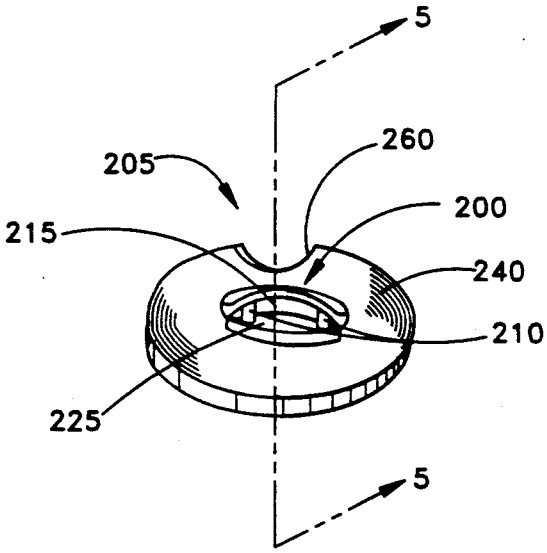
FIG. 3

FIG.4
(Section on line 4 - 4)
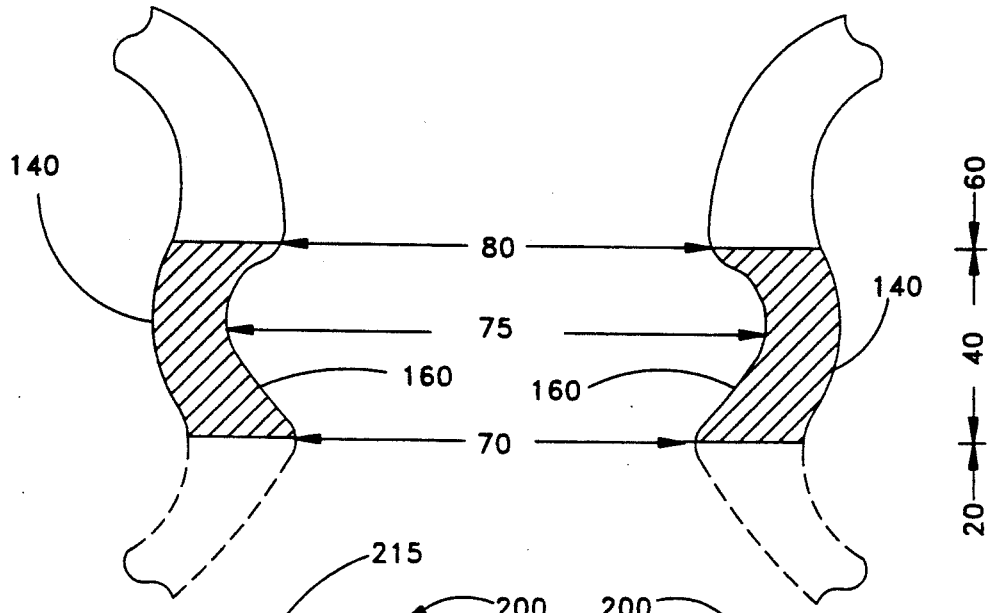
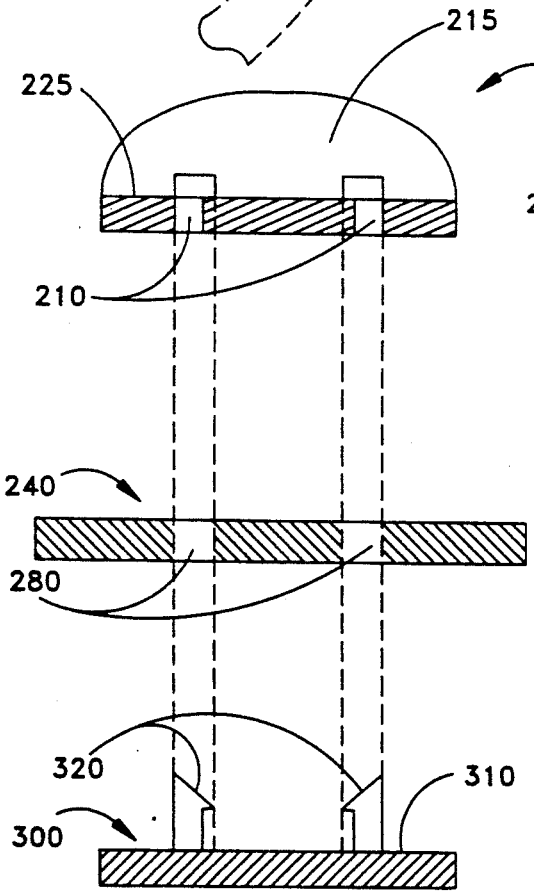
FIG.5
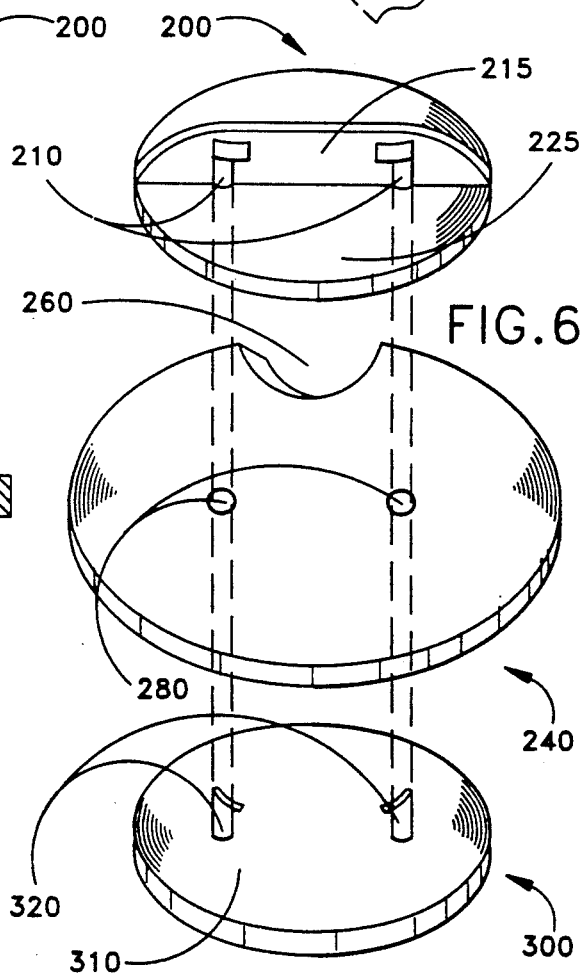
FIG.6

FIG.7
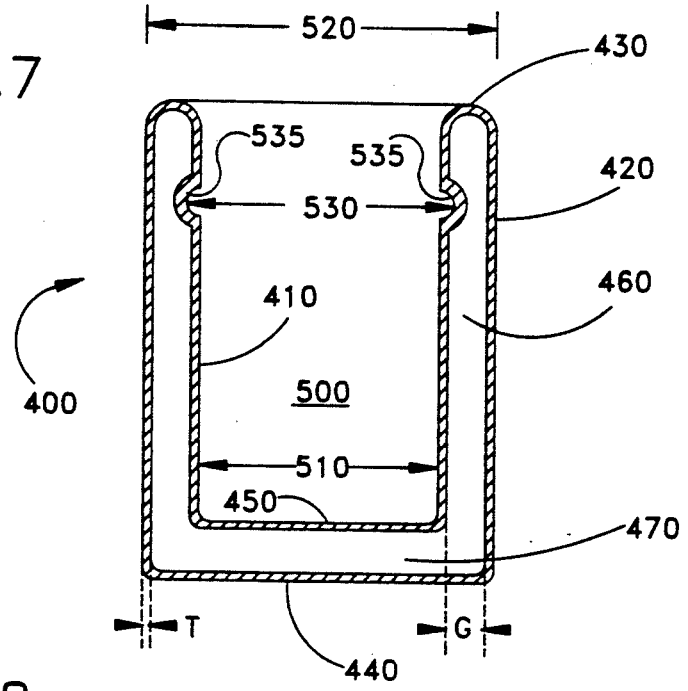
FIG.8
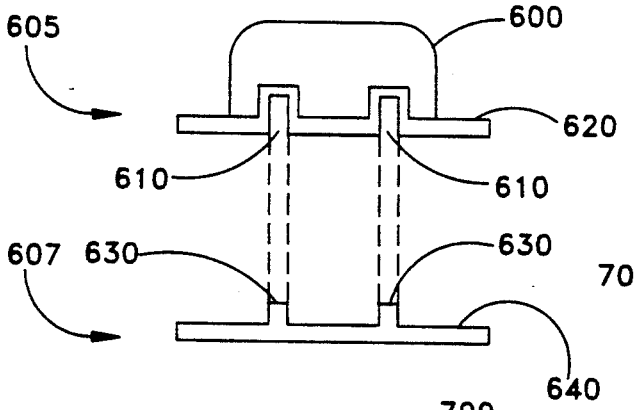
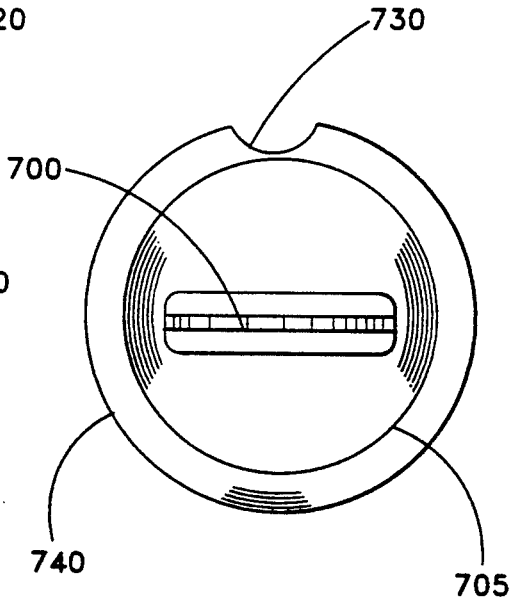
FIG.10
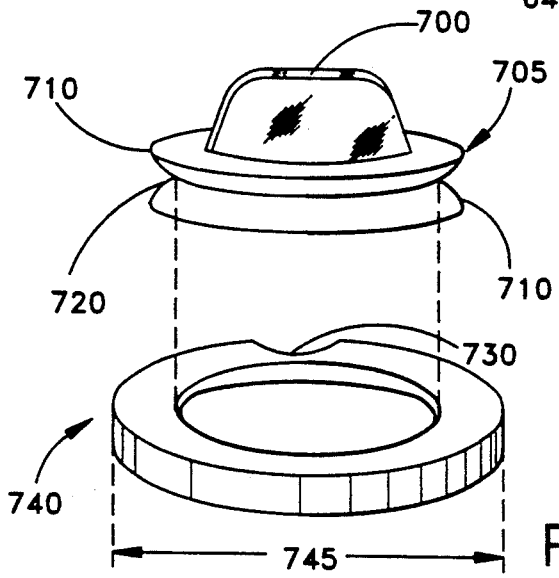
FIG.9

UNIQUE DRINKING MUG AND LID

BACKGROUND OF THE INVENTION

1. Field of the Invention

This invention relates to the field of containers for liquid beverages. Specifically, the present invention is related to the field of liquid beverage containers which: first, prevents the liquid from spilling or splashing out; second, inhibit heat transfer, keeping the contents warm or cold for a period of time; and third, through an effective shape, with a center of gravity close to the base, a mug which resists the tendency to tip over.

Part of the problem which the present invention addresses, is when liquid beverages are contained in a standard mug, the contents can spill or splash out from the top. The contents can be contained by a lid, but it is often cumbersome to remove and replace the lid whenever it is desired to drink from the beverage container. The present invention keeps the fluid from spilling or splashing out of the mug by supplying a lid which has a small notch aperture in the side which, when the lid is put in place, can restrain the fluid from spilling or splashing out from the top of the mug and also keep the fluid warm or cold by providing an insulating surface to the top of the mug. The present invention also is shaped so that the base is significantly wider than most mugs and by this feature it resists the tendency to tip over.

It is often desirable to carry hot liquids in places such as in an automobile. In such a circumstance the container for such hot liquids could be jostled around and it is possible that either the liquid could spill or splash from the top of the container, or the mug could slide or be tipped over. It is also unwise to place and replace a lid onto the mug when participating in an activity such as driving an automobile. The present invention addresses these concerns, in a unique mug and lid beverage container which allows the user to drink liquids from the container while preventing the contents from spilling or splashing from the top of the container, keeping the contents of the container hot or cold, and furthermore resisting the container's tendency to slide or tip over in an easy to manufacture mug and lid configuration.

2. Description of the Prior Art

Containers which contain liquid beverages, such as standard mugs are known in the prior art. Containers known as vacuum bottles are comprised of two walls enclosing a vacuum chamber therebetween and fitted with a metal outer case. The vacuum bottle is completely sealed at its opening by means of a screw cap or cork. Liquid is conventionally dispensed from the vacuum bottle into a mug. While it is possible for one to drink directly from a vacuum bottle, it is not commonly done since the opening is not intended to function as a drinking lip and liquid can easily spill out during the drinking process.

Conventional glasses and mugs are commonly used to hold liquids for drinking purposes. However, their tops are completely open. As a result, the liquid can be retained at its original temperature for only a short period of time. In addition, if the container should accidentally be tipped, the liquid contained therein will spill out.

Therefore, there is no presently known apparatus in the prior art which can retain a liquid for drinking purposes at a temperature close to its original temperature for a period of time, assure that the liquid will not spill out if the container is tipped, and facilitates easy drinking of the liquid from the container.

SUMMARY OF THE PRESENT INVENTION

The present invention relates to the field of liquid beverage containers which prevents the liquid from spilling, inhibits heat transfer, and keeps the container upright.

It has been discovered, according to the present invention, that a beverage mug shaped with a hollow frustum base joined to a concave ring which is additionally joined to a flared lip will: contain a significant amount of liquid; restrict the liquid from spilling out; inhibit the mug from tipping over; inhibit heat transfer, keeping the beverage essentially the same temperature as it is when it is introduced to the container; and provide a design which is easy to drink from. The beverage mug also has a curved handle which is attached to the side of the mug for grasping the unique container.

It has been further discovered, according to the present invention, that a concave inner ring section of the mug with an inner concave shape and outer convex shape will permit a lid structure to be inserted into the concavity of the concave ring section, through the flared lip structure. The inner surface of the mug is shaped in such a way that the lid structure can easily be placed through the opening of the mug, into the recess of the concavity of the ring section and not deeper, so the lid does not fall through into the liquid chamber of the mug.

It has been additionally discovered, according to the present invention, that a lid structure can be formed by the combination of: a finger pull piece, a flexible lid sheet with a flow through aperture, and a lower lock post part; and when properly inserted into the concavity of the ring section of the mug, could prevent liquid from spilling out from the top of the mug and enable just enough liquid to pass through to permit easy drinking of the liquid. The finger pull piece serves as a handle for the lid; the flexible lid sheet tends to seal the top of the mug, except for the narrow flow through aperture which allows a small amount of liquid to pass through; and the lower lock post part is inserted through the flexible lid sheet by snapping into the finger pull piece which sandwiches the flexible lid sheet thereby holding the three pieces securely.

It has been further discovered, according to the present invention, that a double walled vessel to insulate the contents of the mug could be configured with an inner wall groove to retain a flexible lid structure and could thereby retain heat more efficiently.

It has also been discovered, according to the present invention, that a doughnut shaped flexible lid sheet with a side notch could be fitted around a hub structure and finger pull, providing a lid structure which partially retains the liquid contents of the mug and is easy to manufacture.

It is therefore an object of the present invention to provide a beverage mug shaped with a hollow frustum base joined to a concave ring which is additionally joined to a flared lip which will: provide a chamber to contain a significant amount of liquid; restrict the liquid from spilling out; provide a shape for the mug which will inhibit the mug from tipping over; provide a design for the mug which will inhibit heat transfer, keeping the beverage essentially the same temperature as it is when it is introduced to the container; provide a design which is both attractive and from which it is easy to drink; and to provide the beverage mug with a curved handle which is attached to the side of the mug for grasping the container.

It is a further object of the present invention to provide a concave inner ring section of the mug with an inner concave shape and outer convex shape to permit a lid structure to be inserted into the concavity of the concave ring section, through the flared lip structure. The object is also to provide an inner surface of the mug shaped in such a way that the lid structure can easily be placed through the opening of the mug, into the recess of the concavity of the ring section and not deeper, so the lid does not fall through into the liquid chamber of the mug.

It is an additional object of the present invention to provide a lid structure which is formed by the combination of: a finger pull piece, a flexible lid sheet with a flow through aperture, and a lower lock post part which, when properly inserted into the concavity of the ring section of the mug, could prevent liquid from spilling out from the top of the mug and enable just enough liquid to pass through to permit easy drinking of the liquid; where the following functions of each piece are accomplished: the finger pull piece serves as a handle for the lid; the flexible lid sheet seals the top of the mug, except for the narrow flow through aperture which allows a small amount of liquid to pass through; and the lower lock post part is inserted through the flexible lid sheet by snapping into the finger pull piece which sandwiches the flexible lid sheet thereby holding the three pieces securely.

It is a further object of the present invention to provide a double walled vessel to insulate the contents of the mug, which is configured with an inner wall groove to retain a flexible lid structure and could thereby retain heat efficiently.

It is also an object of the present invention to provide a doughnut shaped flexible lid sheet with a side notch, fitted around a hub structure and finger pull, providing a lid structure which partially retains the liquid contents of the mug and is easy to manufacture.

In general, the uniqueness of the present invention is therefore due to the following features and functions. The beverage mug is shaped with a hollow frustum base joined to a concave ring which is additionally joined to a flared lip which will: contain a significant amount of liquid; restrict the liquid from spilling out; inhibit the mug from tipping over; inhibit heat transfer, keeping the beverage inside the container essentially the same temperature as it is when it is introduced to the container; and provide a design which is easy to drink from. The concave inner ring section of the mug with an inner concave shape and outer convex shape permits a lid structure to be inserted into the concavity of the concave ring section and through the flared lip structure. The inner surface of the mug is shaped in such a way that the lid structure can easily be placed through the opening of the mug and into the recess of the concavity of the ring section and not deeper, so the lid does not fall through into the liquid chamber of the mug. Finally, the lid structure is formed by the combination of: a finger pull piece, a flexible lid sheet with a flow through aperture, and a lower lock post part. When properly inserted into the concavity of the ring section of the mug, the lid structure prevents liquid from spilling out from the top of the mug and enables just enough liquid to pass through to permit easy drinking of the liquid. In so doing, the following functions of each piece are accomplished: the finger pull piece serves as a handle for the lid; the flexible lid sheet seals the top of the mug, except for the narrow flow-through aperture which allows a small amount of liquid to pass through; and the lower lock post part is inserted through the flexible lid sheet by snapping into the finger pull piece which sandwiches the flexible lid sheet thereby holding the three lid pieces securely. Each of the features of the invention are designed harmoniously within the article of manufacture as simply as possible, efficiently, functionally, and for the purpose of drinking fluid beverages.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated:

FIG. 1 is a perspective drawing of the mug and lid.

FIG. 2 is a cross section of the mug, taken along line 2—2 of FIG. 1.

FIG. 3 is a perspective drawing of the lid.

FIG. 4 is an enlarged view of the mug ring section taken along line 2—2 of FIG. 2.

FIG. 5 is an exploded cross section of the lid, taken along line 5—5 of FIG. 3.

FIG. 6 is an exploded perspective view of the lid.

FIG. 7 is a cross section of the double walled vessel alternative embodiment.

FIG. 8 is a side view of a press fit lid structure.

FIG. 9 is a perspective view of the hub handle piece and the doughnut shaped flexible lid sheet.

FIG. 10 is a top plan of the hub handle piece and doughnut shaped flexible lid sheet.

DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Referring to FIG. 1, the mug 10 and lid 205, with the lid 205 firmly seated in the mug 10 is shown. The mug 10 has a handle 15 to grip the mug 10. The mug 10 is wide at the base 125 to prevent tipping. The lid 205 has a finger pull piece 200 for inserting and removing the lid 205. The finger pull piece 200 is mounted on a flexible lid sheet 240 which conformably fits to the inner concave ring surface 160. The lid 205 also has a notch aperture 260 which allows a small quantity of liquid to flow through. The lid 205 partially seals the opening of the mug 10 and prevents liquid from splashing up through the opening, and further insulates the contents, keeping hot fluids in the mug 10 hot for a period of time.

Referring to FIGS. 1 and 2, there are three sections to the mug 10; a lip section 60, a ring section 40 and a hollow frustum section 20. At each of these sections there are inner and outer surfaces. The inner surfaces are considered inside the mug 10 and the outside surfaces are at the periphery. There is also a chamber 25 inside the mug 10 which is enclosed by the lid 205.

The outside surfaces of the mug are shown in FIG. 1. The lip rim 180 is at the apex of the mug 10. Below the lip rim 180, as part of the lip section 60, there is an outer lip surface 170 extending circularly around the superior part of the lip section 60. The upward and outward flare of the lip section 60 allows the lid 205 to be easily placed into the mug 10. The outer lip surface 170 circularly meets, at an inferior periphery, the outer convex ring surface 140 which is part of the ring section 40. The ring section 40 holds the lid 205. The outer convex ring surface 140 is a result of the inside deformation of the inner concave ring surface 160 which is formed to compensate for placement of the lid 205. The outer convex ring surface 140 circularly meets, at an inferior periphery, the frustum periphery 100. The frustum periphery 100 is narrow where it meets the outer convex ring surface 140 and is wide at the base 125. The mug 10 is seated on the outer base surface 120 which is basically the flat circular surface under the mug 10. The handle 15 of the mug 10 is shown, in FIGS. 1 and 2, connected at one end, to the outer convex ring surface 140 and to the other end, proximal to the base on the frustum periphery 100.

Therefore, as shown in FIG. 2, there are three geometric sections, excluding the handle 15, which make up the mug 10. Each of the geometric sections are cylindrically symmetrical to a centrally located axis. The sections are named (in order of superior to inferior), the lip section 60, the ring section 40, the hollow frustum section 20 and the base 125 which is a part of the hollow frustum section 20. Again, excluding the handle, there are three exterior peripheral surfaces to the mug 10, plus a lower surface of the base. These surfaces are named (again in order of superior to inferior), the outer lip surface 170, the outer convex ring surface 140, the frustum periphery 100 and the outer base surface 120.

Starting at the lower section there is a hollow frustum section 20. The hollow frustum section 20 derives its shape from a truncated cone. The hollow frustum section 20 is essentially a hollow cone which is solid at the base 125 and periphery but the vertex of the cone has been truncated in a plane parallel to the plane of the base to expose an opening at the top.

The base 125 of the mug has an outer base surface 120 and an inner base surface 130. The hollow frustum section 20 seats to the ground at the outer base surface 120. The base thickness 90 is a generally constant distance between the inner base surface 130 and the outer base surface 120. The base thickness 90 is very important to the weight of the mug 10 and a heavily weighted mug 10 can add to the stability of the mug 10, particularly when the mug 10 is made from a single material such as ceramic. Other materials for constructing the mug can be used, such as plastics, ceramics, a composite of plastic and ceramic materials, or stainless steel. Additional weight at the base 125 of a plastic mug could be included in a mug 10 configuration to provide additional stability.

A properly weighted base 125 of the hollow frustum section 20 will tend to prevent the mug from tipping over when a substantial lateral force is applied to the mug 10. Due to its shape and weight, the mug 10 has positional stability to maintain its upright position even when inertia, which is present when driving in a vehicle, tends to cause the mug to travel in the direction of prior motion (a direction not necessarily the same as the vehicle is traveling). In addition, since the outer base surface 120 has a relatively large surface area compared to many mugs, this large surface area, coupled with a substantial coefficient of static friction between the outer base surface 120 and the surface which the mug 10 is resting on, will prevent the mug from sliding. The outer base surface 120 can be made even more resistant to sliding by roughening the outer base surface 120. In the case of a ceramic mug, the outer base surface is naturally roughened and therefore it would be desirable to prevent the lower base surface from receiving a glazing, which causes the glazed portion of the ceramic to become smooth. A plastic mug 10 can also be roughened somewhat with a cross hatching type pattern which could provide an additional measure of friction against sliding.

In addition, another material such a rubber or plastic could be placed as an outer layer, under the outer base surface 120 to protect table tops or other surfaces from scratches and also increase the friction between the mug 10 and these surfaces. Outer layers of rubber, plastic or other insulating or semi-insulating composite material could partially or totally enclose the mug 10 around the frustum periphery 100 to increase the insulating properties of the mug 10.

The inner frustum wall 110 partially encloses a chamber 25. The inner frustum wall 110 conforms to the outside frustum periphery 100, and a generally constant thickness is maintained between the outside frustum periphery 100 and the inner frustum wall 110.

The hollow frustum section 20 is joined, at a circularly superior interface, to a ring section 40. The ring section 40 has an inner concave ring surface 160 and an outside convex ring surface 140. The inner concave ring surface 160 is a smooth curvature with a widened lid cavity diameter 75, which is where the lid will fit into and be held in place frictionally and through a conformable or slight compression of the flexible lid sheet 240.

The curvature of the inner concave ring surface 160 is such that there is a wide diameter at the lid cavity diameter 75 to allow the lid 205 to be placed into and held securely to the inside of the mug by frictionally holding it to the widest diameter of the inner concave ring surface 160 of the ring section 40.

The lip section 60 is superior to, and is joined to the ring section 40. The lip section 60 has a lip rim 180 at the crest of the mug 10 which is smoothly rounded so there is no abrasion to the lips when drinking out of the mug.

Referring to FIG. 1 and 2, there is a handle 15 which is generally attached to the side of the mug 10. In the present embodiment, the top of the handle extends from a placement at the ring section 40, and extends outward in a generally outward curved manner proximal to base 120 at the lower part of the frustum periphery 100. The handle 15 connection is from the outer convex ring surface 140 to the lower part of the frustum periphery 100 and intersects a plane which extends through the cylindrically symmetrical axis of the mug 10 sections.

Referring to FIG. 3, there is a lid 205, shown with a finger pull piece 200 which is attached to the flexible lid sheet 240. The lid 205 is designed to be placed into the opening of the mug 10 and to be handled by the finger pull piece 200. The notch aperture 260 allows a small quantity of liquid to flow through, although the bulk of liquid which could spill or splash up and out of the mug 10 is contained by the flexible lid sheet 240 which forms a seal around the opening of the mug 10. The flexible lid sheet 240 also serves an insulating function and reduces heat transfer between the contents of the mug 10 and the coldness or heat excitations at the region outlying the opening of the mug 10.

Referring to FIGS. 5 and 6, an exploded view of the lid 205 is illustrated. The lid 205 consists of a finger pull 200, a flexible lid sheet 240, and a lock post part 300.

The finger pull 200 is used for grasping the lid 205 and has two cylindrically shaped lock post cavities 210 which are open from under the finger pull 200 and used in conjunction with the lock posts 320 of the lock post part 300. The lock post cavities 210 receive the lock posts 320 which are embedded in the narrow grasping piece 215 which is the means for handling the lid 205. The lock post cavities 210 will have a means for clasping the lock post 320 structures which are inserted into the lock post cavities 210. The grasping piece 215 is connected to a pull plate 225 which, when assembled, will interface flush to the upper surface of flexible lid sheet 240.

The flexible lid sheet 240 has an outer periphery which conformably fits to the inner concave ring surface 160 of the mug 10, and the generally circular outer periphery of the flexible lid sheet 240 has a small notch aperture 260 to allow a small amount of beverage to flow through. The flexible lid sheet 240 also has two lock post holes 280 punched through an off center region of the disk shaped flexible lid sheet 240 fitting to the lock posts 320 of the lock post part 300 and the lock post holes 280 which locks into the grasping piece 215 of the finger pull piece 200.

The lock post part 300, has two lock posts 320 which are positioned to push through the lock post holes 280 of the flexible lid sheet 240 and fit into the cylindrically shaped lock post cavities 210 of the finger pull piece 200, and the lock posts 320 are positioned normal to the plane of the lock post plate 310 surface. The finger pull piece 200 and the lock post part 300 fit together harmoniously, effectively sandwiching the flexible lid sheet 240 and holding the flexible lid sheet 240 securely.

The flexible lid sheet 240 could be made from a flexible plastic material. The properties of the flexible lid sheet 240 should be that it is flexible enough to deform when it is set into position, but rigid enough to be held in place by a frictional fit. Also, the material should maintain its deformable solid characteristics over the temperature range which beverages are normally served.

Referring to FIG. 4, there is an enlarged view of the ring section 60. An outer convex ring surface 140 is shown with an outward or bulging curvature and an inner concave ring surface 160 which is curved inwardly to securely hold the lid 205. The three significant diameters shown are, the inner truncation diameter 70, the lid cavity diameter 75 and the inner ring/lip interface diameter 80.

The inner truncation diameter 70 should be narrow enough to support the lid 205 and not allow it to drop through the passage. The inside curvature at this interface between the ring section 40 and the hollow frustum section 20 could be smooth and curved or abruptly narrow with sharp edges depending on the materials or the manufacturing means. In the present embodiment, as shown in FIG. 4, the curvature to this inner truncation diameter 70 is knee-shaped.

The lid cavity diameter 75 is wider than the two other inside ring diameters, but is still narrow enough to hold the lid 205 by the flexible lid sheet 240 periphery which will stay in place by a frictional fit.

The inner ring/lip interface diameter 80 is generally large than the inner truncation diameter 70, but more narrow than the lid cavity diameter 75. The inner ring/lip interface diameter 80 must be wide enough to allow the lid 205 to be pushed through, and placed generally into the region between the inner truncation diameter 70 and the inner ring/lip interface diameter 80.

By correctly choosing these inner ring diameters, the inner concave ring surface 160 will be shaped such that the surface can allow the lid 205, shown in FIG. 3, to be placed into this region without allowing the lid 205 to slip through into the chamber 25. The inner concave ring surface 160 will also hold the lid 205 securely in place by friction and slight compression of the flexible lid sheet 240. Although the inner concave ring surface 160 is generally a smooth curvature, it could also be more abrupt and slotted so the lid 205 could be snapped into place.

Referring to FIG. 7, in an alternative embodiment, there is a double walled vessel 400 which is utilized for its insulating properties. There is a side spacing 460 between the inner wall 410 and the outer wall 420 where the side spacing 460 serves as an insulating layer between the inner wall 410 and the outer wall 420. The spacing distance G between the inner wall 410 and the outer wall 420 defines the gap between the two walls. Also, there is a bottom spacing 470 which is between the inner bottom 450 and the outer base 440. The inside chamber 500 of the double walled vessel 400, where the hot liquid is contained, is kept thermally insulated. The vessel also has a handle 490 so that a user can hold the vessel while drinking hot fluid retained in chamber 500.

Along the surface of the inner wall 410 superior to the inner wall chamber 500, there is an inside wall groove 535 where the lid conformably fits, with an inside wall groove diameter 530. The inside wall groove diameter 530 is wider than the inner wall diameter 510. The outer wall diameter 520 is the distance across the cylindrical outer periphery. The inner wall chamber 500 is bounded by the inside wall groove 535 where the lid would be placed. The double walled vessel 400 could utilize any of the lid embodiments discussed in the present invention.

The double walled vessel 400 inhibits heat transfer. The base spacing 470 and the side spacing 460 provide insulation, especially when the spacing region is evacuated. Conductive heat energy transfer requires a physical system as a conducting medium. Heat does not conduct through vacuum, because in a vacuum there is no physical system to excite. Therefore, conductive heat energy transfer from the inner wall 410 to the outer wall 420 is very low with the exception of the minimal amount from the inner wall 410 to the outer wall 420 through the wall vessel lip 430. In addition, radiant heat transfer from the inner wall chamber 500 will be very low because much of it will reflected by the boundary surface at the inner wall 410.

The double walled vessel 400 can be made from various materials, although it is primarily made from stainless steel. In construction of the double walled vessel, the material is generally of a single thickness T, and could be deformed into the double walled vessel 400 by stamping a thin stainless steel sheet in a tempering process. Other metallic materials such as aluminum or metal alloys could be used. In addition, glass or plastic could be used to construct the double walled vessel 400.

The double walled vessel 400 can have several variations to the double walled design. One such variation is to have insulating material at the walled vessel lip 430. This would provide an insulating barrier which could reduce the heat conduction to the walled vessel lip 430, preventing heat from being conducted across the walled vessel lip 430, to the outer wall 420 which could sink heat. This will also facilitate drinking from the vessel. Insulating material at the walled vessel lip 430 or anywhere between the inner wall 410 at the interface region of the inner wall chamber 500 boundary and the walled vessel lip 430, would inhibit the heat from being conducted from the inner wall 410 to the outer wall 420. In practical consideration of manufacturing, the insulating material could be introduced as a sealing member to contain negative vacuum pressure between the inner wall 410 and the outer wall 420. Insulating material could be from glass, plastic, ceramic, composite, latex, or a low heat conduction metallic, matal alloy material.

In addition, a vacuum does not necessarily need to be maintained between the inner wall 410 and the outer wall 420 to insulate the inner chamber 500 from heat energy conduction. Very good insulating properties can be obtained by having normal room pressure between the inner wall 410 and the outer wall 420 because air has a low thermal conductivity.

Other embodiments of the double walled vessel 400 can include an insulated handle 490 made from plastic, glass, ceramic or composite. There can also be an outer wall insulating layer, which would fit around the outer wall 420 of the double walled vessel 400, made from plastic, glass, latex, ceramic or composite. And there can be an inner insulated wall, which fits in the inside chamber 500, and has properties of low thermal conduction such as glass, plastic, ceramic or composite.

Referring to FIG. 8, there is the side view of an alternative lid structure, with an upper press fit piece 605 and a lower press fit piece 607. The upper press fit piece 605 has a press fit handle piece 600 with press fit indentations 610 through the press fit upper plate 620. The lower press fit piece 607 has press fit ridges 630, extending above the press fit lower plate 640 which snugly fit to the press fit indentations 610 of the upper press fit piece 605. A flexible lid sheet structure could be sandwiched between the upper press fit piece 605 and the lower press fit piece 607, as shown in FIG. 3, FIG. 5 and FIG. 6. Or the two pieces could be adapted to the alternative flexible lid sheet piece shown in FIG. 9.

Referring to FIG. 9, there is a perspective view of an alternative flexible lid sheet piece, a doughnut shaped flexible lid sheet 740 which fits around a double tapered hub 705. The double tapered hub 705 is joined to the hub handle piece 700. The hub handle piece 700 is connected to a double tapered hub 705. The double tapered hub 705 has an inner circumference 720 which is less of a distance than the two outside circumferences 710. The doughnut shaped flexible lid sheet 740 has an outer doughnut diameter 745 which extends across its widest diameter. There is a doughnut type notch aperture 730 used for allowing fluid to pass through when in use.

Referring to FIG. 10, there is a top plan view of the alternative lid with the hub handle piece 700 connected to the double tapered hub 705. The doughnut shaped gasket 740 is located outside the circumference of the double tapered hub 705. The doughnut shaped gasket 740 has an doughnut type notch aperture 730.

Defined in detail, the present invention is an improved drinking mug and lid, to contain hot or cold fluid beverages without allowing the fluid to spill or splash out, which allows a person to drink from the container while the lid is in place, and which reduces heat transfer keeping the fluid generally the same temperature for a period of time, comprising:

a. a mug part, comprising:
   i) a hollow frustum section which has an inner frustum wall and an outer frustum periphery, a narrow upper diameter, a wide lower diameter, and a sealed base at the wide lower diameter;
   ii) a ring section having an upper part and a lower part, which ring section is circularly joined at its lower part to the narrow upper diameter of the frustum section, and which has an inner concave ring surface and an outside convex ring surface where the lid conformably fits to the inner concave ring surface;
   iii) a lip section which is circularly joined to the upper part of the ring section, which has an inner lip surface, an outer lip surface and lip rim at the crest of the lip section which is rounded so that there will be no sharp edges to the upper lip for a smooth surface which will prevent abrasion to a person's lips when drinking out of the mug, where the diameter of the lip rim is wider than the diameter of the interface between the lip section and the upper part of the ring section; and
   iv) a handle attached from the wide lower diameter of the frustum shape to the outside convex ring surface of the ring section;

b. a lid part, comprising:
   i) a flexible lid sheet having an upper and lower surface, with a generally circular outer periphery, where the outer periphery of the flexible lid sheet conformably fits into the inner concave ring surface of the mug, at least one centrally located lock post hole to adapt to a finger pull part and a lock post part, and where the generally circular outer periphery of the flexible lid sheet has a small notch aperture to allow a small amount of beverage to flow through for drinking while the lid is in place;
   ii) a lock post part aligned beneath the lower surface of the flexible lid sheet and having at least one lock post which extends the lock post hole in the flexible lid sheet;
   iii) a pull plate aligned above the upper surface of the flexible lid sheet and which seats to the upper flexible lid sheet surface and attached to the at least one lock post such that the flexible lid sheet is sandwiched between the lock post and the pull plate; and
   iv) a finger pull part for handling the flexible lid sheet attached to the pull plate.

Defined alternatively, the present invention is an improved drinking mug and lid, to contain hot or cold fluid beverages without allowing the fluid to spill or splash out, which allows a person to drink from the container while the lid is in place, and which significantly reduces heat transfer, keeping the fluid generally the same temperature for a period of time, comprising:

a. a double walled vessel comprised of an inner wall and an outer wall, separated by a side spacing between the inner wall and the outer wall and a bottom spacing between an inner bottom on the outer base;

b. an inside chamber, bounded at the periphery by an inner wall diameter of the inner wall, where the inner chamber is thermally insulated from the outer wall of the double walled vessel;

c. an inside wall groove in the inner wall which is wider than the inner wall diameter of the inner wall which bounds the inside chamber; and d. a lid part which removably fits to the inside wall groove in the inner wall, the lid part comprised of a finger pull for handling the lid part and a flexible lid sheet with a notch aperture on its circumference for allowing a small amount of fluid to flow through for drinking while the lid is in place.

Defined broadly, the present invention is an improved drinking mug and lid, to contain hot or cold fluid beverages without allowing the fluid to spill or splash out, which allows a person to drink from the container while the lid is in place, and which reduces heat transfer keeping the fluid generally the same temperature for a period of time, comprising:

a. a mug part comprised of a hollow frustum section with a base which is joined to a ring section which has an inner concave ring surface to securely hold a lid part, and a lip section which is joined to the ring section; and b. a lid part which removably fits to the inner concave ring surface of the ring section of the mug, the lid part comprised of a flexible lid sheet with a notch aperture on its circumference for allowing a small amount of fluid to flow through for drinking while the lid is in place and a finger pull for handling the lid part.

Defined more broadly, the present invention is an improved drinking mug and lid combination comprising: a. a mug part comprised of a hollow section with a base which is joined to a ring section which has an inner concave ring surface to securely hold a flexible lid part, and a lip section which is joined to the ring section; and b. a flexible lid part which removably fits to the inner concave ring surface of the ring section of the mug, the flexible lid part comprised of a flexible lid sheet with a notch aperture on its circumference for allowing a small amount of fluid to flow through for drinking while the lid is in place and a finger pull for handling the lid part.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modification in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. An improved drinking mug and lid, to contain hot or cold fluid beverages without allowing the fluid to spill or splash out, which allows a person to drink from the container while the lid is in place, and which reduces heat transfer keeping the fluid generally the same temperature for a period of time, comprising:

a. a mug part, comprising:

i) a hollow frustum section which has an inner frustum wall and an outer frustum periphery, a narrow upper diameter, a wide lower diameter, and a sealed base at the wide lower diameter;

ii) a ring section having an upper part and a lower part, which ring section is circularly joined at its lower part to the narrow upper diameter of the frustum section, and which has an inner concave ring surface and an outside convex ring surface where the lid conformably fits to the inner concave ring surface;

iii) a lip section which is circularly joined to the upper part of the ring section, which has an inner lip surface, an outer lip surface and a lip rim at the crest of the lip section which is rounded so that there will be no sharp edges to the lip rim for a smooth surface which will prevent abrasion to a person's lips when drinking out of the mug, where the diameter of the lip rim is wider than the diameter of the interface between the lip section and the upper part of the ring section; and iv) a handle attached from the wide lower diameter of the frustum shape to the outside convex ring surface of the ring section;

b. a lid part, comprising:

i) a flexible lid sheet having an upper and lower surface, with a generally circular outer periphery, where the outer periphery of the flexible lid sheet conformably fits into the inner concave ring surface of the mug, at least one lock post hole for allowing at least one lock post to extend through, and where the generally circular outer periphery of the flexible lid sheet has a small notch aperture to allow a small amount of beverage to flow through for drinking while the lid is in place;

ii) a lock post part aligned beneath the lower surface of the flexible lid sheet and having at least one lock post which extends through the at least one lock post hole in the flexible lid sheet;

iii) a pull plate aligned above the upper surface of the flexible lid sheet and which seats to the upper flexible lid sheet surface and attached to the at least one lock post such that the flexible lid sheet is sandwiched between the lock post part and the pull plate; and iv) a finger pull part for handling the flexible lid sheet attached to the pull plate.

2. The invention in accordance with claim 1 where the material used in the construction of the mug is ceramic.

3. The invention in accordance with claim 1 where the material used in the construction of the mug is plastic.

4. The invention in accordance with claim 1 where the material used in the construction of the mug is stainless steel.

5. The invention in accordance with claim 1 where the inner concave ring surface of the ring section has a circular ridge where the lid can be positioned.

6. The invention in accordance with claim 1 where the base of the mug is roughened to keep the mug from sliding.

7. The invention in accordance with claim 1 where the lid is made from plastic.

8. An improved drinking mug and lid, to contain hot or cold fluid beverages, without allowing the fluid to spill or splash out, which allows a person to drink from the container while the lid is in place, and which reduces heat transfer keeping the fluid generally the same temperature for a period of time, comprising:

a. a mug part comprised of a hollow frustum section with a base which is joined to a ring section which has an inner concave ring surface to securely hold a lid part, and a lip section which is joined to the ring section, where the lip section gradually flares upwardly and outwardly and has a lip rim, and the diameter of the lip rim is wider than the diameter of the interface between the lip section and the ring section; and b. a lid part which removably fits to the inner concave ring surface of the ring section of the mug, the lid part comprised of a flexible lid sheet with a notch aperture on its circumference for allowing a small amount of fluid to flow through for drinking while the lid is in place and a finger pull piece for handling the lid part.

9. The invention in accordance with claim 8 where the material used in the construction of the mug is ceramic.

10. The invention in accordance with claim 8 wherein said lid part further comprises an upper part and a lower part, where the flexible lid sheet is sandwiched by the upper part and the lower part.

11. The invention in accordance with claim 8 where the material used in the construction of the mug is plastic.

12. The invention in accordance with claim 8 where the material used in the construction of the mug is stainless steel.

13. The invention in accordance with claim 8 where the lid is made of plastic.

14. The invention in accordance with claim 8 where the inner concave ring surface of the ring section has a circular ridge where the lid is positioned.

15. The invention in accordance with claim 8 further comprising a handle for carrying the mug.

16. An improved drinking mug and lid combination comprising:

a. a mug part comprised of a hollow section with a base which is joined to a ring section which has an inner concave ring surface to securely hold a flexible lid part, and a lip section which is joined to the ring section; and b. a lid part which removably fits to the inner concave ring surface of the ring section of the mug, the flexible lid part comprised of a generally flat flexible lid sheet with a notch aperture on its circumference for allowing a small amount of fluid to flow through for drinking while the lid is in place, the lid part further comprising an upper part and a lower part, where the flexible lid sheet is sandwiched by the upper part and the lower part.

17. The invention in accordance with claim 16 further comprising a handle for carrying the mug.

18. The invention in accordance with claim 16 where the inner concave ring surface of the ring section has a circular ridge where the lid is positioned.

19. The invention in accordance with claim 16 where said lower part of said lid part fits in a press fit arrangement to said upper part of said lid part.

* * * * *